US011668443B2

(12) United States Patent
Wright et al.

(10) Patent No.: US 11,668,443 B2
(45) Date of Patent: Jun. 6, 2023

(54) LUMINAIRE UPLIGHT DEVICE AND RELATED METHODS

(71) Applicant: LSI Industries, Inc., Cincinnati, OH (US)

(72) Inventors: Travis Wright, Cincinnati, OH (US); Nikhil Kochar, Blue Ash, OH (US); Shane Jelliffe, Cincinnati, OH (US); Eric Jon Mooar, Liberty Township, OH (US); Christopher Linn Papa, Liberty Township, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 17/746,152

(22) Filed: May 17, 2022

(65) Prior Publication Data

US 2022/0364696 A1 Nov. 17, 2022

Related U.S. Application Data

(60) Provisional application No. 63/189,257, filed on May 17, 2021.

(51) Int. Cl.
*F21S 8/06* (2006.01)
*F21V 21/08* (2006.01)
(Continued)

(52) U.S. Cl.
CPC ..... *F21S 8/06* (2013.01); *F21V 21/08* (2013.01); *F21V 23/002* (2013.01); *F21Y 2105/18* (2016.08); *F21Y 2115/10* (2016.08)

(58) Field of Classification Search
CPC .. F21S 8/06; F21S 8/036; F21V 21/08; F21V 23/002; F21V 7/0016; F21V 7/0008; F21Y 2105/18; F21Y 2115/10; F21Y 2103/33
See application file for complete search history.

(56) References Cited

U.S. PATENT DOCUMENTS 4,858,091 A 8/1989 Fouke
5,111,370 A 5/1992 Clark
(Continued)

FOREIGN PATENT DOCUMENTS

CN 105972524 B 5/2019
CN 110906219 A 3/2020
(Continued)

OTHER PUBLICATIONS

LSI Industries Inc., Excursion Parking Garage Luminaire, Edge-Lit, Glare-Free LED Technology, www.lsi-industries.com, 2018 (7 pages).
(Continued)

*Primary Examiner* — Peggy A Neils
(74) *Attorney, Agent, or Firm* — Wood Herron & Evans LLP

(57) ABSTRACT

An uplight device for use with a luminaire that has a housing configured to be supported from a surface by a stem with a wireway. The uplight device includes a body having a radially outwardly directed annular flange, a vertically oriented annular rim encircling the annular flange, and a passageway extending through the body, and an uplight substrate supported on a first side of the annular flange. The uplight substrate includes a plurality of light emitting sources arranged in an array on a first side of the uplight substrate. The uplight device further includes an optical lens covering the first side of the annular flange and the uplight substrate. The body of the uplight device is configured to be coupled between the stem and housing of the luminaire such that the passageway communicates with the wireway of the stem and a chamber of the luminaire.

20 Claims, 9 Drawing Sheets

(51) Int. Cl.

| | |
|---|---|
| ***F21V 23/00*** | (2015.01) |
| ***F21Y 115/10*** | (2016.01) |
| ***F21Y 105/18*** | (2016.01) |

(56) References Cited

U.S. PATENT DOCUMENTS

| | | | |
|---|---|---|---|
| 5,343,373 | A | 8/1994 | Tillotson |
| 5,806,967 | A | 9/1998 | Soorus et al. |
| 6,398,384 | B2 | 6/2002 | Siminovitch et al. |
| 6,478,454 | B1 | 11/2002 | Jaffari et al. |
| D470,931 | S | 2/2003 | Hidalgo |
| 7,052,157 | B1 | 5/2006 | Lau |
| 7,070,303 | B2 | 7/2006 | Kassay et al. |
| 7,445,362 | B2 | 11/2008 | Compton et al. |
| 8,282,248 | B1 | 10/2012 | Burt |
| 9,057,503 | B2 | 6/2015 | Catalano |
| 9,200,782 | B1 | 12/2015 | Erickson et al. |
| 9,404,646 | B2 | 8/2016 | Clark et al. |
| 9,416,925 | B2 | 8/2016 | Sarmadi et al. |
| D784,597 | S | 4/2017 | Wilson |
| 9,644,800 | B2 | 5/2017 | Purdy |
| 9,655,191 | B2 | 5/2017 | Vissenberg et al. |
| 9,752,754 | B2 | 9/2017 | Trincia et al. |
| 9,869,455 | B2 | 1/2018 | Horvath et al. |
| 10,100,987 | B1 | 10/2018 | Dell'Ario |
| 10,139,060 | B1 | 11/2018 | Erdener et al. |
| 10,237,951 | B1 | 3/2019 | Quilici et al. |
| 10,393,344 | B2 | 8/2019 | Gibbs et al. |
| 10,443,814 | B2 | 10/2019 | Zhang et al. |
| 10,451,249 | B2 | 10/2019 | Dahlen et al. |
| 10,473,281 | B1 | 11/2019 | Sonneman et al. |
| 10,488,001 | B2 | 11/2019 | Sonneman et al. |
| 10,775,018 | B1 | 9/2020 | Grove et al. |
| 10,816,163 | B1 | 10/2020 | Hsu |
| 10,935,196 | B2 | 3/2021 | Wilcox et al. |
| 11,022,261 | B2 * | 6/2021 | Hawthorne ..... F21S 8/061 |
| 2011/0273886 | A1 | 11/2011 | Lu et al. |
| 2014/0268766 | A1 | 9/2014 | Lu |
| 2015/0009666 | A1 | 1/2015 | Keng et al. |
| 2015/0276169 | A1 | 10/2015 | Bullard et al. |
| 2016/0010804 | A1 * | 1/2016 | Barnetson ..... F21K 9/232 362/235 |
| 2017/0322364 | A1 * | 11/2017 | Girotto ..... F21V 23/0485 |
| 2019/0211997 | A1 | 7/2019 | Murphy |

FOREIGN PATENT DOCUMENTS

| | | | |
|---|---|---|---|
| EP | 2919560 | A1 | 9/2015 |
| KR | 102083812 | B1 | 3/2020 |
| WO | 2018228207 | A1 | 12/2018 |

OTHER PUBLICATIONS

LSI Industries Inc., High Performance Lighting Solutions For Parking Lots and Parking Garage Applications, Parking Garage Lighting Brochure, www.lsicorp.com, Oct. 23, 2020 (8 pages).

* cited by examiner

LUMINAIRE UPLIGHT DEVICE AND RELATED METHODS

CROSS-REFERENCE TO RELATED APPLICATION

The present application claims the filing benefit of U.S. Provisional Application Ser. No. 63/189,257, filed May 17, 2021, the disclosure of which is incorporated herein by reference in its entirety.

FIELD OF THE INVENTION

This invention relates generally to luminaires and, more particularly, to an uplight device for use with a luminaire to provide the luminaire with uplighting capabilities.

BACKGROUND OF THE INVENTION

Lighting fixtures, otherwise referred to as luminaires in the lighting industry, are commonly used in trafficked areas including enclosed or partially enclosed garages, tunnels, parking lots or other similar areas that require illumination. For areas in which there are both cars and pedestrians, such as a parking garage, commercial luminaire installations provide an important safety function by effectively illuminating these areas for both pedestrians and drivers. Luminaires also provide an important security function by deterring theft and vehicle break-ins. In this regard, parking garage luminaires are typically arranged overhead of the trafficked area, such as on a ceiling of the parking garage, for example. That way, each luminaire emits light in a downward direction to illuminate the trafficked area where pedestrians and vehicles are located.

For commercial garage luminaire installations it is particularly important to control the glare and direction of the downward light to avoid creating a dark ceiling, otherwise referred to in the industry as a "cavern effect." In almost all cases, this effect is undesirable because a dark ceiling is unnatural and uncomfortable to the human eye which perceives a space to be brighter when it is lit uniformly. To avoid this cave-like effect, garage luminaire installations are often configured to direct a certain amount of light in an upward direction. Uplighting is typically achieved using a reflective lens, transparent housing, or other similar means.

For a garage luminaire installation that does not have uplighting capabilities, it may be necessary to equip the luminaire with additional light sources that are separate from the downwardly emitting light source. These additional light sources are configured to emit light in the upward direction. However, installation of the uplight component to the luminaire comes with the additional expense of installation hardware, labor, and secondary machining operations to the luminaire housing, which are all undesirable. Moreover, any secondary machining operations to the housing of the luminaire are particularly undesirable as they greatly increase the potential for water ingress into the luminaire through the machined areas, which may include sealing grommets, fasteners, or other similar hardware. To this end, any amount of moisture ingress into the housing of the luminaire may cause damage and require a full replacement of the luminaire installation.

Accordingly, it is desirable to improve upon existing luminaire uplight devices to provide for a more cost effective and efficient installation to a luminaire that requires no secondary machining operations to the luminaire housing for installation thereto.

SUMMARY OF THE INVENTION

The present invention overcomes the foregoing and other shortcomings and drawbacks of known luminaire uplight devices. While the invention will be described herein in connection with certain embodiments, it will be understood that the invention is not limited to these embodiments. On the contrary, the invention includes all alternatives, modifications, and equivalents as may be included within the spirit and scope of the invention.

According to one embodiment of the present invention, an uplight device for use with a luminaire is provided. The luminaire includes a housing configured to be supported from a surface by a stem having a wireway, an optical frame coupled to the housing, and a luminaire substrate mounted within a chamber of the luminaire. The luminaire substrate includes a plurality of light emitting sources arranged thereon and electrically coupled to a driver positioned within the chamber. The uplight device includes a body having a radially outwardly directed annular flange, a vertically oriented annular rim encircling the annular flange, and a passageway extending through the body. The uplight device further includes an uplight substrate supported on a first side of the annular flange and having a plurality of light emitting sources arranged in an array on a first side of the uplight substrate, and an optical lens covering the first side of the annular flange and the uplight substrate. The body of the uplight device is configured to be coupled between the stem and housing of the luminaire such that the passageway communicates with the wireway of the stem and the chamber of the luminaire.

According to one aspect of the present invention, the plurality of light emitting sources arranged on the uplight substrate are configured to emit light in a direction away from a direction in which light is emitted from the plurality of light emitting sources arranged on the luminaire substrate.

According to another aspect of the present invention, the passageway extends between an open end of a first portion of the body and an open end of a second portion of the body. In yet another aspect, the substrate includes a through hole configured to receive the first portion of the body therethrough. According to one aspect of the invention, the first portion of the body is configured to threadably couple to the stem and the second portion of the body is configured to threadably couple to the housing of the luminaire.

According to yet another aspect, the uplight device includes a chamber between an outer surface of the body, the first side of the flange, and the rim. According to one aspect, the substrate is positioned within the chamber. According to another aspect, the optical lens encloses the substrate within the chamber. According to one aspect, the optical lens is an optical encapsulant.

According to another aspect of the invention, the body of the uplight device further includes a wireway extending through the body and fluidly communicating with the passageway. The wireway is configured to permit routing of electrical wiring between the uplight substrate and the driver of the luminaire.

According to one aspect, the plurality of light emitting sources arranged in an array on a first side of the uplight substrate are arranged in a plurality of concentric circles. According to another aspect, each of the plurality of concentric circles are configured to output a different color of light.

According to yet another aspect, the first side of the flange includes one or more alignment pins configured to engage one or more corresponding apertures in the uplight substrate.

According to another embodiment of the present invention, a luminaire assembly is provided. The luminaire assembly includes a luminaire having a housing configured to be supported from a surface by a stem having a wireway, an optical frame coupled to the housing, and a luminaire substrate mounted within a chamber of the luminaire that includes a plurality of light emitting sources electrically coupled to a driver positioned within the chamber. The luminaire assembly includes an uplight device having a body having a radially outwardly directed annular flange, a vertically oriented annular rim encircling the annular flange, and a passageway extending through the body and between the stem of the luminaire assembly and the housing of the luminaire assembly. The uplight device further includes an uplight substrate supported on a first side of the annular flange and having a plurality of light emitting sources arranged in an array on the uplight substrate and an optical lens covering the first side of the annular flange and the uplight substrate. To this end, the passageway of the uplight device communicates with the wireway of the stem and the chamber of the housing.

According to one aspect of the invention, the plurality of light emitting sources arranged on the uplight substrate are configured to emit light in an opposite direction compared to a direction in which light is emitted from the plurality of light emitting sources arranged on the luminaire substrate. According to another aspect of the invention, electrical wiring for the luminaire is routed through the passageway.

According to one aspect of the present invention, the body of the uplight device further includes a wireway extending through the body and fluidly communicating with the passageway, the wireway being configured to permit routing of electrical wiring between the uplight substrate and the driver of the luminaire. According to another aspect, electrical wiring for the luminaire and electrical wiring for the uplight substrate is routed through the passageway. According to yet another aspect, the substrate includes a through hole through which the passageway extends.

According to one aspect of the present invention, the plurality of light emitting sources arranged in an array on a first side of the uplight substrate are arranged in a plurality of concentric circles.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

Figure 1:
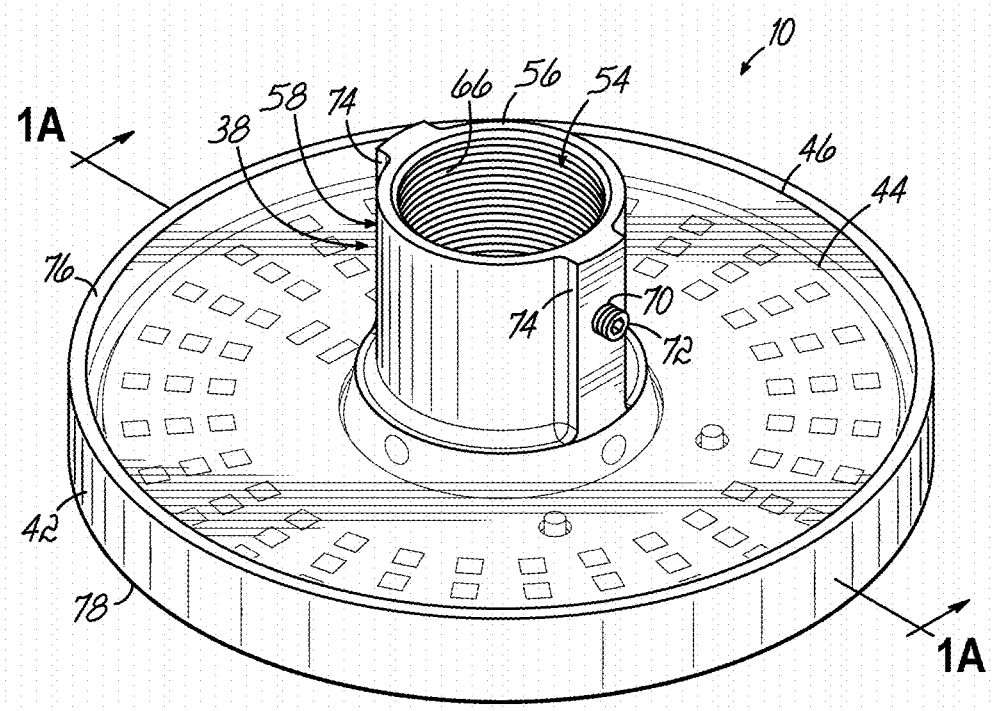
FIG. 1 is a perspective view of an uplight device according to an exemplary embodiment of the invention.

With reference to FIGS. 1 through 4, an uplight device 10 is shown according to an exemplary embodiment of the invention. With reference to FIGS. 2A through 4, an exemplary luminaire assembly 12 according to one embodiment is illustrated in which the uplight device 10 of the invention has particular utility. As shown (e.g., FIG. 4), the uplight device 10 is installed to a luminaire 14, which may be a commercial parking garage luminaire, or downlight, for example. More particularly, the uplight device 10 is coupled between a housing 16 of the luminaire 14 and a stem 18 configured to support the luminaire assembly 12 from a surface, such as a ceiling of a parking garage, for example. As will be described in more detail below, the uplight device 10 may be attached to the luminaire 14 without the need for any secondary machining operations to the housing 16. In this regard, the uplight device 10 may be considered a module or adapter for the luminaire 14, which may be a stock assembly, for example. To this end, wiring for both the uplight device 10 and luminaire 14 may be routed through the uplight device 10, as described in further detail below.

Figure 3:
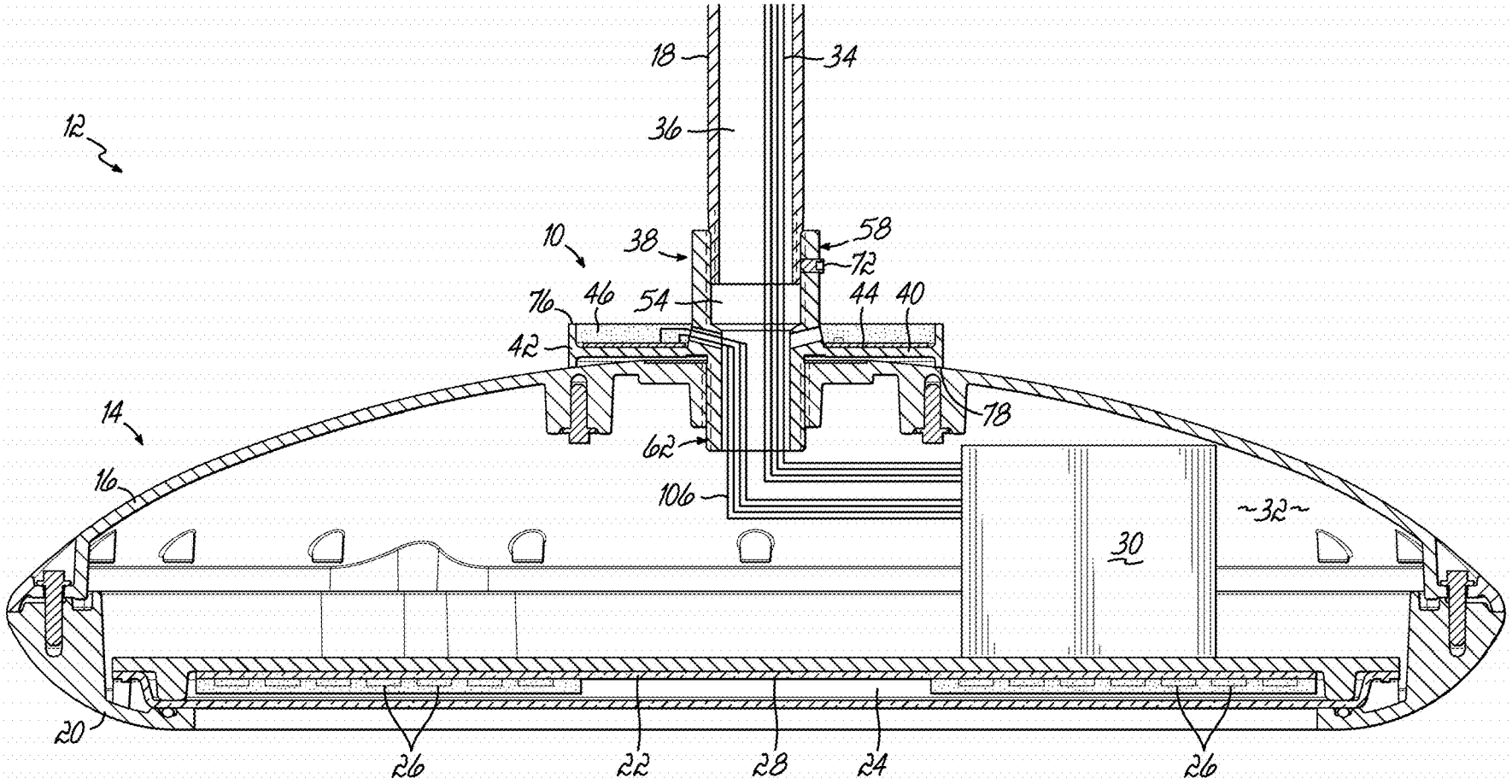
FIG. 3 is a cross-section view of the luminaire assembly of FIG. 2C.

As shown in FIG. 3, the luminaire 14 generally includes the housing 16 configured to be supported from a surface by the stem 18, an optical frame 20 coupled to the housing 16, and a substrate 22 mounted within a light emitting chamber 24 of the luminaire 14. The substrate 22 includes a plurality of light emitting sources 26 arranged on a side 28 of the substrate 22 that is downward facing. The light emitting sources 26 are electrically coupled to a driver 30 positioned within an electrical component chamber 32 of the luminaire 14. The driver 30 may be a constant voltage, constant current, or constant power driver that drives the power to one or more of the light emitting sources 26 arranged on the substrate 22, as would be understood by a person of ordinary skill in the art. The driver 30 is configured to be electrically coupled to an external power source (not shown) via electrical wires 34 that are electrically coupled to, and routed from, the driver 30 and through a wireway 36 extending through the stem 18. The stem 18 may be threaded conduit piping, for example. The luminaire 14 may further include various other components known in the art, such as a heatsink, a lens, and an optical array cover such as a silicone optical array, for example. While the invention is described herein in connection with a commercial parking garage luminaire, or downlight, it will be understood that the invention is not limited to this embodiment. Rather, the principles of the invention described herein, in its broader aspects, are applicable to luminaire assemblies and related fixtures generally.

Figure 1A:
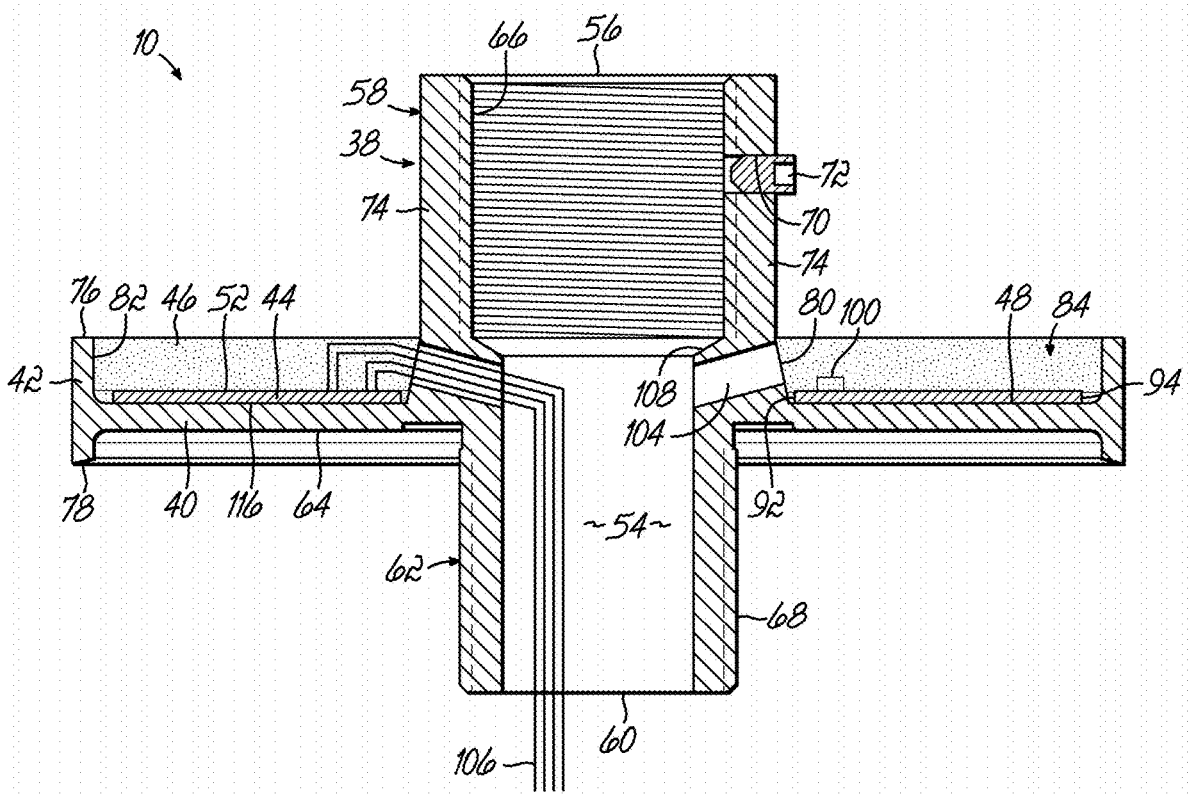
FIG. 1A is a cross-section view of the uplight device of FIG. 1, illustrating wiring of the uplight device.
Figure 1B:
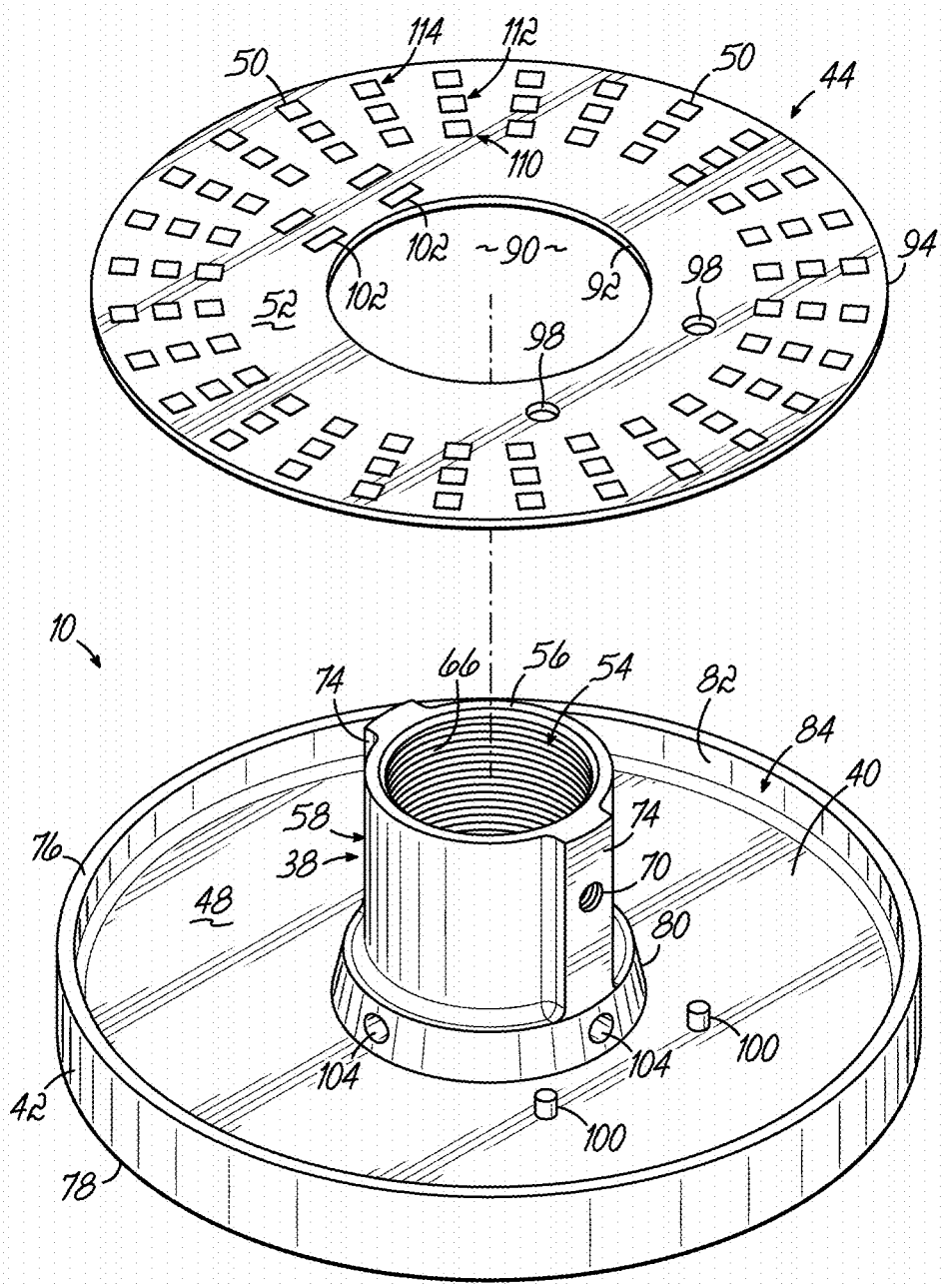
FIG. 1B is a disassembled view of the uplight device of FIG. 1, illustrating assembly of a substrate to the uplight device.

With reference now to FIGS. 1 through 1B, details of the exemplary uplight device 10 are shown according to one embodiment of the invention incorporating various aspects for providing more efficient installation of the uplight device 10 to the luminaire 14 without the need for secondary machining operations to components of the luminaire 14. The exemplary uplight device 10 includes a generally tubular-shaped body 38 having an annular, plate-like flange 40 extending radially outwardly from the body 38. The flange 40 further includes a vertically-oriented peripheral rim 42 that encircles the annular flange 40. In one embodiment, the flange 40 is generally centrally located along an elongate length of the body 38. As shown, the flange 40 is configured to support a substrate 44 and an optical lens 46 for the uplight device 10. More particularly, the substrate 44 is positioned on a first side 48 of the flange 40 with the optical lens 46 positioned over the substrate 44 to thereby cover the first side 48 of the flange 40 and the substrate 44. As will be described in further detail below, the optical lens 46 is configured to enclose the substrate 44 between the optical lens 46 and the first side 48 of the flange 40.

The substrate 44 includes a plurality of light emitting sources 50, such as light emitting diodes ("LEDs"), arranged in an array on a first side 52 of the substrate 44. In this regard, the substrate 44 supports and electrically connects the plurality of light emitting sources 50 and may be a printed circuit board ("PCB"), for example. As will become more clear below, once the uplight device 10 is coupled to the luminaire 14, the plurality of light emitting sources 50 provide the luminaire assembly 12 with uplighting capabilities. While the light emitting sources 50 are shown and described herein as LEDs, other light emitting sources may be used in addition to, or instead of LEDs, and are within the scope of the present disclosure. By way of example only, other light emitting sources such as plasma light sources may be used. As used herein, the term "LEDs" is intended to include all types of light emitting diodes including organic light emitting diodes ("OLEDs), and LEDs that generate different colors of light.

With continued reference to FIGS. 1 through 1B, the body 38 of the uplight device 10 further includes a passageway 54 that extends between an open end 56 of a first portion 58 of the body 38 and an open end 60 of a second portion 62 of the body 38. In this regard, the passageway 54 extends the length of the body 38 (i.e., the distance between the open end 56 of the first portion 58 and the open end 60 of the second portion 62). As shown, the first portion 58 of the body 38 projects in an upward direction from the first side 48 of the flange 40 and the second portion 62 of the body 38 projects in a downward direction from an opposite, second side 64 of the flange 40. The tubular shape of the first and second portions 58, 62 of the body 38 facilitate the coupling of the uplight device 10 to the stem 18 and the housing 16 of the luminaire 14. More particularly, an inner surface 66 of the first portion 58 of the body 38 is provided with threads and an outer surface 68 of the second portion 62 is provided with threads. As shown, an inner diameter of the threaded inner surface 66 of first portion 58 may be similar to an outer diameter of the threaded outer surface 68 of the second portion 62. To couple the uplight device 10 between the stem 18 and housing 16 of the luminaire 14, as will be described in further detail below, the first portion 58 of the body 38 of the uplight device 10 is configured to threadably receive a threaded portion of the stem 18 therein and the second portion 62 of the body 38 is configured to threadably couple to the housing 16 of the luminaire 14.

In the embodiment shown, the first portion 58 of the body 38 further includes a threaded bore 70 configured to receive a set screw 72 therein. In this regard, the first portion 58 of the body 38 may include one or more elongated bosses 74 with the bore 70 extending through at least one of the bosses 74. To this end, the increased wall thickness of the boss 74 provides the bore 70 with a larger threaded surface area and thus a larger thread count for the set screw 72 to engage. The set screw 72 may be used to prevent the stem 18 from being uncoupled from the uplight device 10.

As described above, the flange 40 of the uplight device 10 is configured to support the substrate 44. As shown in FIG. 1A, the flange 40 is annular in shape and extends from the body 38 of the uplight device 10 to the rim 42 and radially about the body 38. In the embodiment shown, the rim 42 is coaxial with the body 38 of the uplight device 10 and extends a distance above the first side 48 of the flange 40 and terminates at a top edge 76. Similarly, the rim 42 extends a distance below the flange 40 and terminates at a bottom edge 78. As shown in FIGS. 1 and 1A, the first side 48 of the flange 40 extends between an outer, beveled surface 80 of the body 38 and an inner surface 82 of the rim 42. In this regard, the outer surface 80 of the body 38, first side 48 of the flange 40, and inner surface 82 of the rim 42 define a chamber 84. To this end, the substrate 44 is positioned in the chamber 84 when mounted to the first side 48 of the flange 40. When so positioned, the plurality of LEDs 26 arranged on the substrate 44 are upwardly facing to thereby provide uplighting when the uplight device 10 is mounted to the luminaire 14, as will be described in more detail below.

With reference to FIGS. 1 through 1B, the substrate 44 is generally cylindrical in shape and includes a centrally located through hole 90. In this regard, the substrate 44 may be generally ring shaped. As shown, the shape of the substrate 44 generally corresponds to the shape of the flange 40, and more particularly the first side 48 of the flange 40. As shown, the centrally located through hole 90 is sized to receive the first portion 58 of the body 38 of the uplight device 10 therethrough so that the substrate 44 may be mounted to the flange 40. When mounted to the flange 40, as best shown in FIGS. 1 and 1A, the substrate 44 is positioned flush along the first side 48 of the flange 40 with the first portion 58 of the body 38 extending through the through hole 90 of the substrate 44. More particularly, the passageway 54 is directed through the through hole 90 in the substrate 44. When positioned on the first side 48 of the flange 40, an inner edge 92 of the substrate 44 faces the outer surface 80 of the body 38 and an outer edge 94 of the substrate 44 faces the inner surface 82 of the rim 42.

To facilitate mounting of the substrate 44 to the flange 40, and more particularly to align the substrate 44 about the flange 40, the substrate 44 includes one or more apertures 98 configured to receive one or more corresponding alignment pins 100 therethrough. As shown, the one or more alignment pins 100 are positioned on the first side 48 of the flange 40 and may be spaced apart about the flange 40, for example. As best shown in FIG. 1B, to mount the substrate 44 to the flange 40, the substrate 44 is positioned over the flange 40 with the one or more apertures 98 aligned with the one or more pins 100. Similarly, the centrally located through hole 90 in the substrate 44 is aligned with the first portion 58 of the body 38. The substrate 44 is then received on the first side 48 of the flange 40 with the one or more pins 100 positioned through the corresponding apertures 98 in the substrate 44, as shown in FIG. 1. Similarly, the first portion 58 of the body 38 is received through the through hole 90 in the substrate 44.

The engagement between the one or more pins 100 and the corresponding apertures 98 in the substrate 44 serves multiple purposes. First, the abutting relationship between the pins 100 and the corresponding apertures 98 prevents the substrate 44 from rotating about the body 38 of the uplight device 10. In this regard, any movement of the substrate 44 after it has been installed and wired is undesirable as it can lead to wire damage and performance issues. Second, the corresponding pin 100 and aperture 98 engagement causes the substrate 44 to self-align about the flange 40 and body 38 of the uplight device 10. More particularly, when the substrate 44 is mounted to the flange 40, the corresponding pin 100 and aperture 98 engagements position one or more connectors 102 located on the first side 52 of the substrate 44 adjacent to a wireway 104 through the body 38 of the uplight device 10. The one or more connectors 102 provide power to the LEDs 50 and are configured to be electrically coupled to one or more power supply wires 106 which are routed through the wireway 104, as will be described in additional detail below. To this end, by adjacent it is meant that the one or more connectors 102 are located near the wireway 104 so that the electrical supply wires 106 may be easily routed from the substrate 44 (e.g., the one or more connectors 102) to a separate power source. In one embodiment, the one or more connectors 102 may be aligned with an opening of the wireway 104.

As shown in FIG. 1A, each of the one or more wireways 104 extend through the body 38 of the uplight device 10 and fluidly communicate with the passageway 54. More particularly, the one or more wireways 104 each extend from an opening on the outer, beveled surface 80 of the body 38 through the body 38 to the passageway 54. Thus, each wireway 104 may be a bore through the body 38 of the uplight device 10. As shown, the wireway 104 extends through the body 38 at a location along the body 38 between the first portion 58 and second portion 62. In the embodiment shown, each wireway 104 is configured to permit routing of electrical wires 106 from the one or more connectors 102, or any other electrical components on the substrate 44, through the wireway 104 and into the passageway 54. As will become more clear below, once the uplight device 10 is coupled to the luminaire 14, the electrical wires 106 may then be routed through the passageway 54 and into the electrical component chamber 32 of the luminaire 14 where they may be electrically coupled to a power source and/or controller.

With continued reference to FIG. 1A, the diameter of the passageway 54 is reduced from the first portion 58 of the body 38 to the second portion 62 of the body 38 at a shoulder 108. As shown, the shoulder 108 is located between the first portion 58 and second portion 62 of the body 38 and is positioned just above the wireway 104. In that regard, the shoulder 108 prevents over insertion of the stem 18 into the first portion 58 of the uplight device 10, thereby preventing the stem 18 from damaging the wiring 106 extending through the wireway 104. As shown in FIG. 3, the stem 18 may be threaded into the first portion 58, but is prevented from being inserted too far so as to be interfering the wireway 104 by the shoulder 108.

With reference to FIGS. 1 through 1A, details of the optical lens 46 of the uplight device 10 will now be described. The optical lens 46 provides optical control to the plurality of LEDs 50 creating optimal optical distributions, while simultaneously sealing the substrate 44 from the environment. As shown, the optical lens 46 of the uplight device 10 is positioned on the first side 48 of the flange 40 to thereby cover the first side 48 of the flange 40 and the substrate 44. The optical lens 46 also seals each wireway 104 from the environment to prevent any contaminates from entering the passageway 54 and ultimately the luminaire 14. The seal between the optical lens 46 and the substrate 44 and wireway 104 may be hermetic, for example. In the embodiment shown, the optical lens 46 is formed from an optical encapsulant. The optical encapsulant may be an optical-quality silicone encapsulant, resin encapsulant, urethane or polyurethane encapsulant, or other similar means for optically encapsulating the substrate. In another embodiment, the optical lens 46 may be a clear or translucent conformal coating that covers the first side 48 of the substrate 44. The lens of this embodiment may be a thin polymeric film formed of a resin, parylene, or other suitable material.

To form the optical lens 46, the substrate 44 is first positioned within the chamber 84 and arranged on the first side 48 of flange 40 with the appropriate electrical wiring 106 connected to the substrate 44 and routed through the wireway 104 and into the passageway 54, as described above and shown in FIG. 1A. When so positioned, each wireway 104 is sealed with an epoxy resin to prevent the ingress of any uncured encapsulant. The chamber 84 is then filled with the optical encapsulant which is cured to form the optical lens 46. In the embodiment shown, the chamber 84 may be filled with optical encapsulant to a fill level that is coplanar with the top edge 76 of the rim 42. The optical encapsulant is configured to fill any voids and openings in the chamber 84 to thereby cover and seal the substrate 44 and the one or more wireways 104 from the environment. Once the optical encapsulant is fully cured, as shown in FIGS. 1 and 1A, the uplight device 10 may be installed to the luminaire 14.

In an alternative embodiment, the optical lens 46 formed from an optical encapsulant may be replaced with an optical lens formed from glass, polycarbonate, polymethylmethacrylate, Zeonex, a silicone mat, or other similar structure for sealing the chamber 84 from the environment. The optical lens of this embodiment may be snap-fit, glued, fastened, or otherwise attached to the uplight device 10. In another embodiment, the optical lens may include discrete optics covering the plurality of light emitting sources 50 or an optical array (e.g., a silicone mat) provided with a plurality of optics corresponding to the array of light emitting sources 50. In this embodiment, the optics maximize light dispersion and the efficiency of each LED. If desired, the optical lens of this embodiment may also include an encapsulant, conformal coating, or other suitable structure to seal the electrical components of the uplight device 10 from the environment.

Figure 1C:
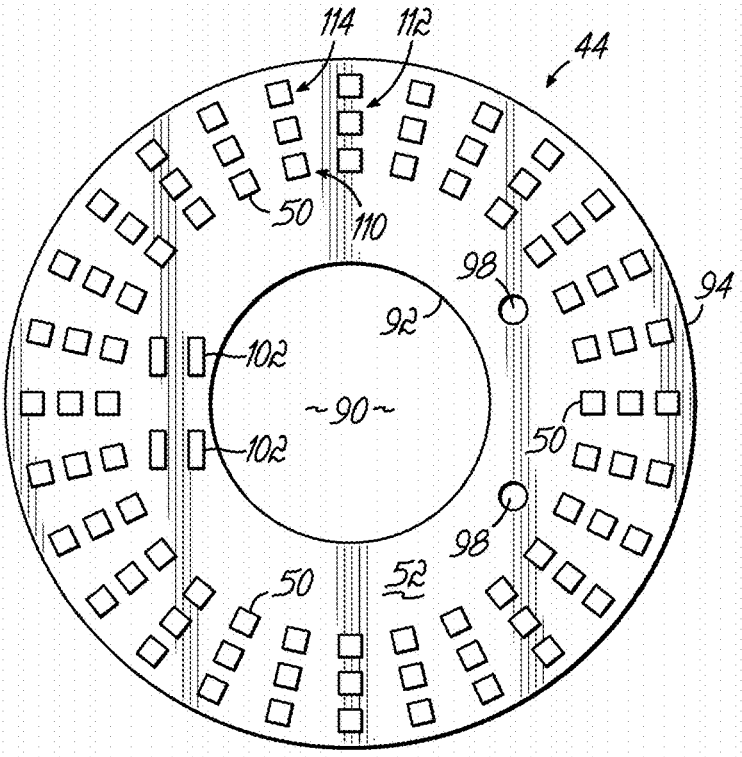
FIG. 1C is a top view of a first side of the substrate shown in FIGS. 1A through 1B.
Figure 1D:
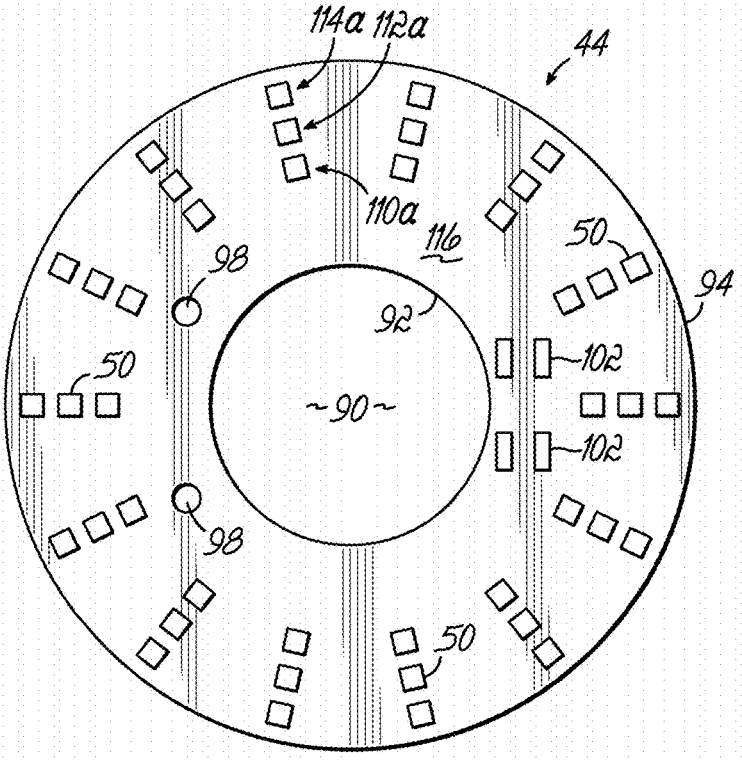
FIG. 1D is a top view of a second side of the substrate shown in FIGS. 1A through 1C.

Turning now to FIGS. 1C through 1D, details of the exemplary substrate 44 are shown. As shown in FIG. 1C, the plurality of light emitting sources 50 are arranged in an array on the first side 52 of the substrate 44. More particularly, the array consists of three concentric circles of LEDs 50. In this regard, the array of LEDs 50 are arranged about the substrate 44 in a first circle 110 of LEDs 50, a larger second circle 112 of LEDs 50, and an even larger third circle 114 of LEDs 50. As shown, the first circle 110 of LEDs 50 is positioned closest to the inner edge 92 of the substrate 44, the third circle 114 of LEDs 50 is positioned closest to the outer edge 94 of the substrate 44, and the second circle 112 of LEDs 50 is positioned between the first and third circles 110, 114. Each circle 110, 112, 114 of LEDs 50 may contain a quantity of 28 LEDs 50, for example. Further, each circle 110, 112, 114 of LEDs 50 may be configured to output a different color of light. For example, the first circle 110 may be configured to output 3000 Kelvin, the second circle 112 may be configured to output 4000 Kelvin, and the third circle 114 may be configured to output 5000 Kelvin. However, other light color configurations are contemplated as being within the scope of the invention, such as any color of light within the visible spectrum of light, for example. While the exemplary embodiment shows three concentric circles with each circle having 28 LEDs 50, it is within the scope of the invention to include fewer or more concentric circles with fewer or more LEDs 50, as desired. It is also within the scope of the invention to have LEDs with color tuning capabilities. In that regard, the color tuning may be performed after the uplight device is already installed.

Turning now to FIG. 1D, a second side 116 of the substrate 44 is shown. In the embodiment shown, the second side 116 of the substrate 44 may also include an array of light emitting sources 50 and one or more connectors 102 arranged thereon. Similar to the first side 52 of the substrate 44, the array of LEDs 50 on the second side 116 of the substrate 44 may also be arranged in three concentric circles 110*a*, 112*a*, 114*a* of LEDs 50, with each circle containing a quantify of 14 LEDs 50. In this regard, the second side 116 of the substrate 44 may be configured to output different (e.g., less bright or, alternatively, more bright) color configurations compared to the first side 52 of the substrate 44 as a result of having fewer or more LEDs 50 per circle. For example, the first side 52 of the substrate 44 may output more lumens compared to the second side 116 of the substrate 44. Similar to the LEDs 50 arranged on the first side 52 of the substrate 44, each circle 110*a*, 112*a*, 114*a* of LEDs 50 on the second side 116 of the substrate 44 may be configured to output a different color of light within the range of 2000 to 6000 Kelvin, for example. By having LED's 50 arranged on both the first and second side 52, 116 of the substrate 44, less substrate 44 inventory is needed by the manufacturer or supplier of uplight devices 10 to assemble a variety of uplight devices 10 that output different colors of light at different light intensities.

In one embodiment, the body 38, flange 40, and rim 42 of the uplight device 10 may be formed as a unitary piece. In this regard, the body 38, flange 40, and rim 42 may be constructed from plastic, aluminum, tin, steel, iron, or any other similar castable or machinable materials, and may be formed using a die cast manufacturing process, a machining process using a computer numerical control (CNC) machine, or an injection molding process. However, one skilled in the art would appreciate that other materials and other manufacturing processes may be suitably utilized. Furthermore, while the flange 40 and substrate 44 in the embodiment shown as having a circular cross-sectional shape, other polygonal or round cross-sectional shapes may be used and are within the scope of the invention. For example, in one embodiment, the flange 40 and substrate 44 may have a square or hexagonal cross-sectional shape.

Figure 2A:
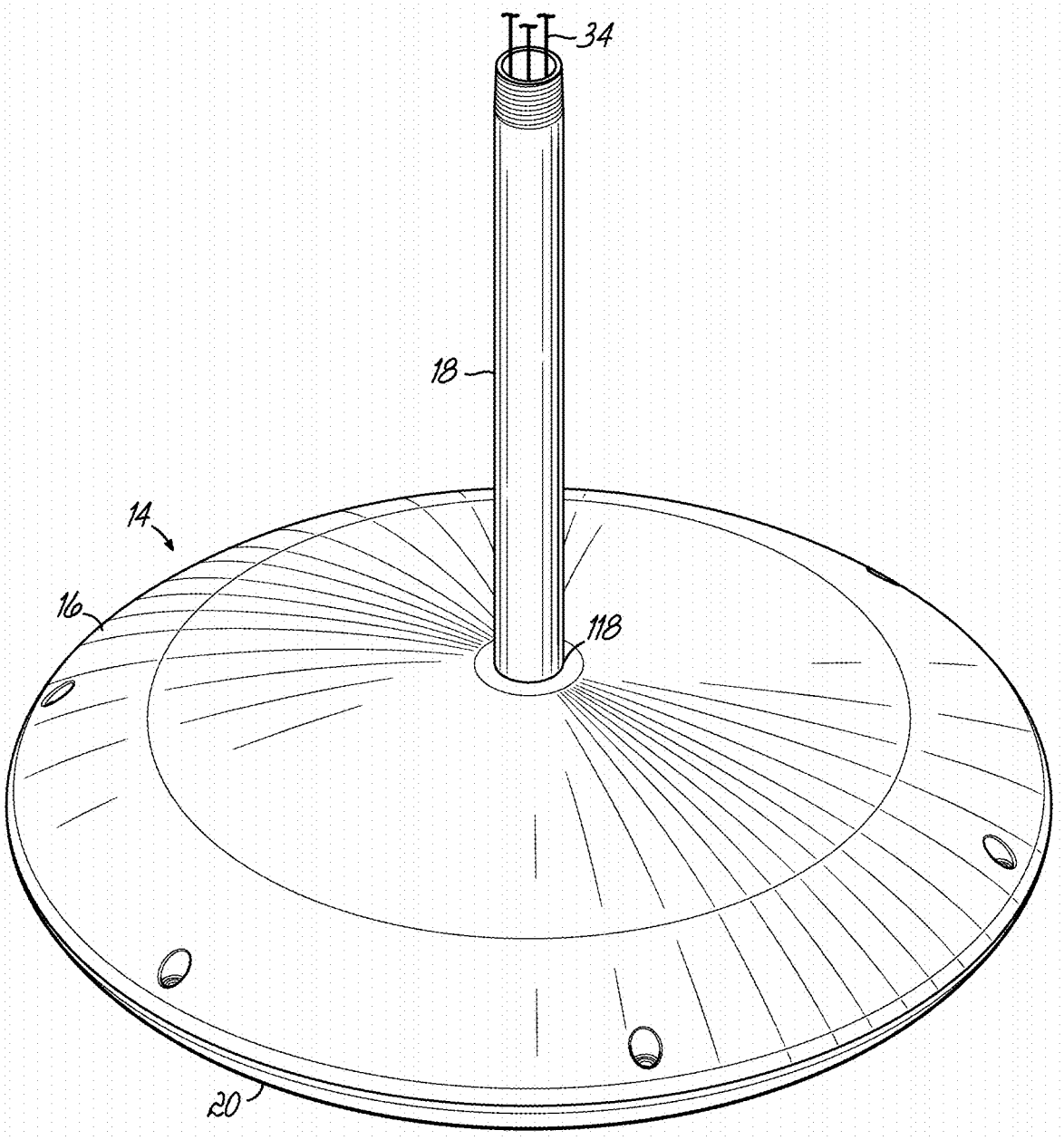
FIG. 2A is a perspective view of a luminaire according to an exemplary embodiment of the invention.

Turning now to FIGS. 2A through 3, installation of the uplight device 10 to the luminaire 14 will now be described. In this regard, the uplight device 10 may be installed to the luminaire 14 in a factory setting or, alternatively, the uplight device 10 may be provided as a kit to be installed to an existing luminaire 14 (e.g., a luminaire 14 already installed a parking garage). With reference to FIG. 2A, the exemplary downlight luminaire 14 is shown without the uplight device 10 installed. In this regard, a threaded portion of the stem 18 is threaded into a port 118 in the housing 16 such that the stem 18 is configured to support the luminaire 14 from a surface, such as a ceiling of a parking garage, for example.

Figure 2B:
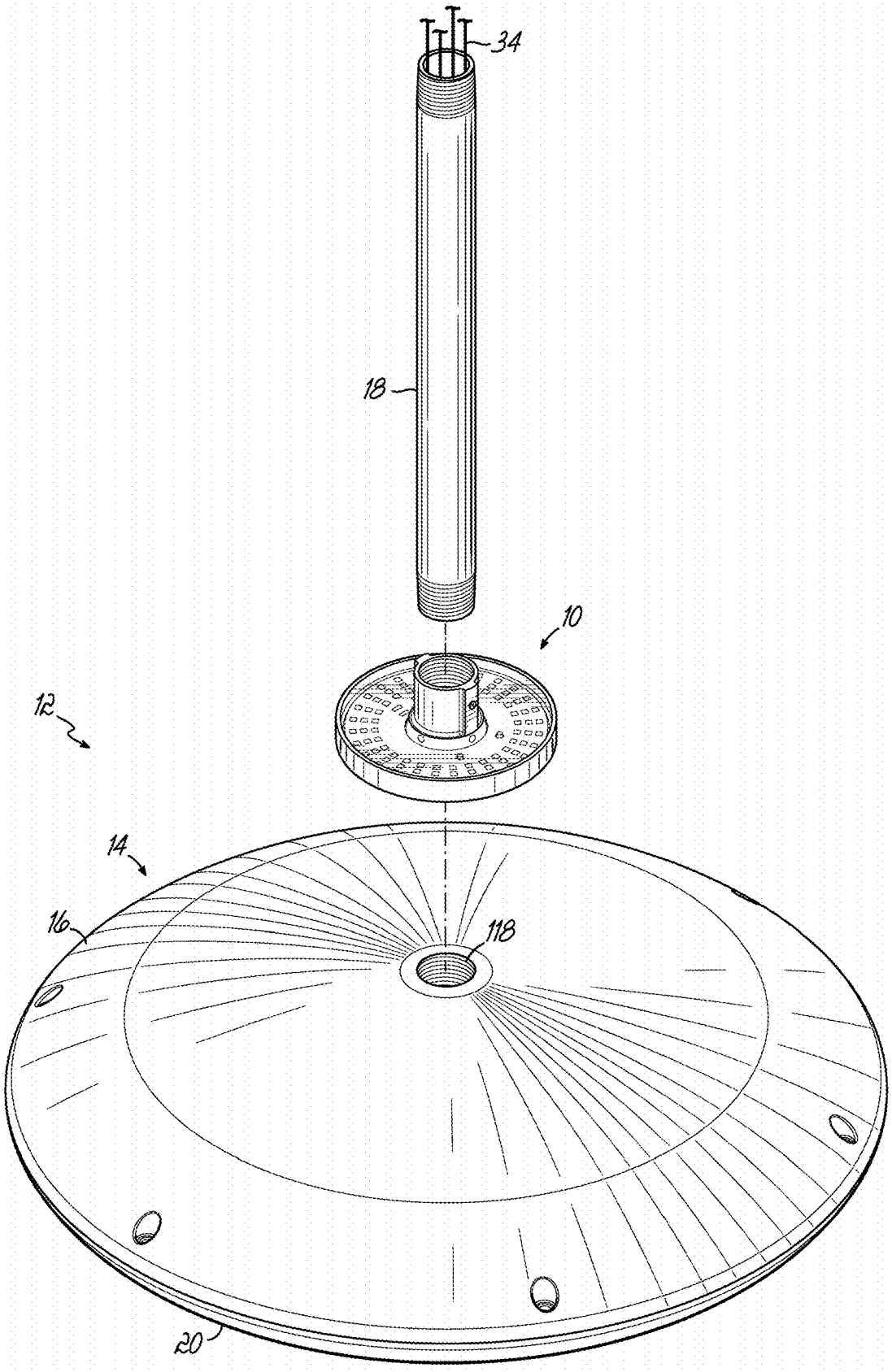
FIG. 2B is a perspective view illustrating assembly of the uplight device of FIG. 1 to the luminaire of FIG. 2A.
Figure 2C:
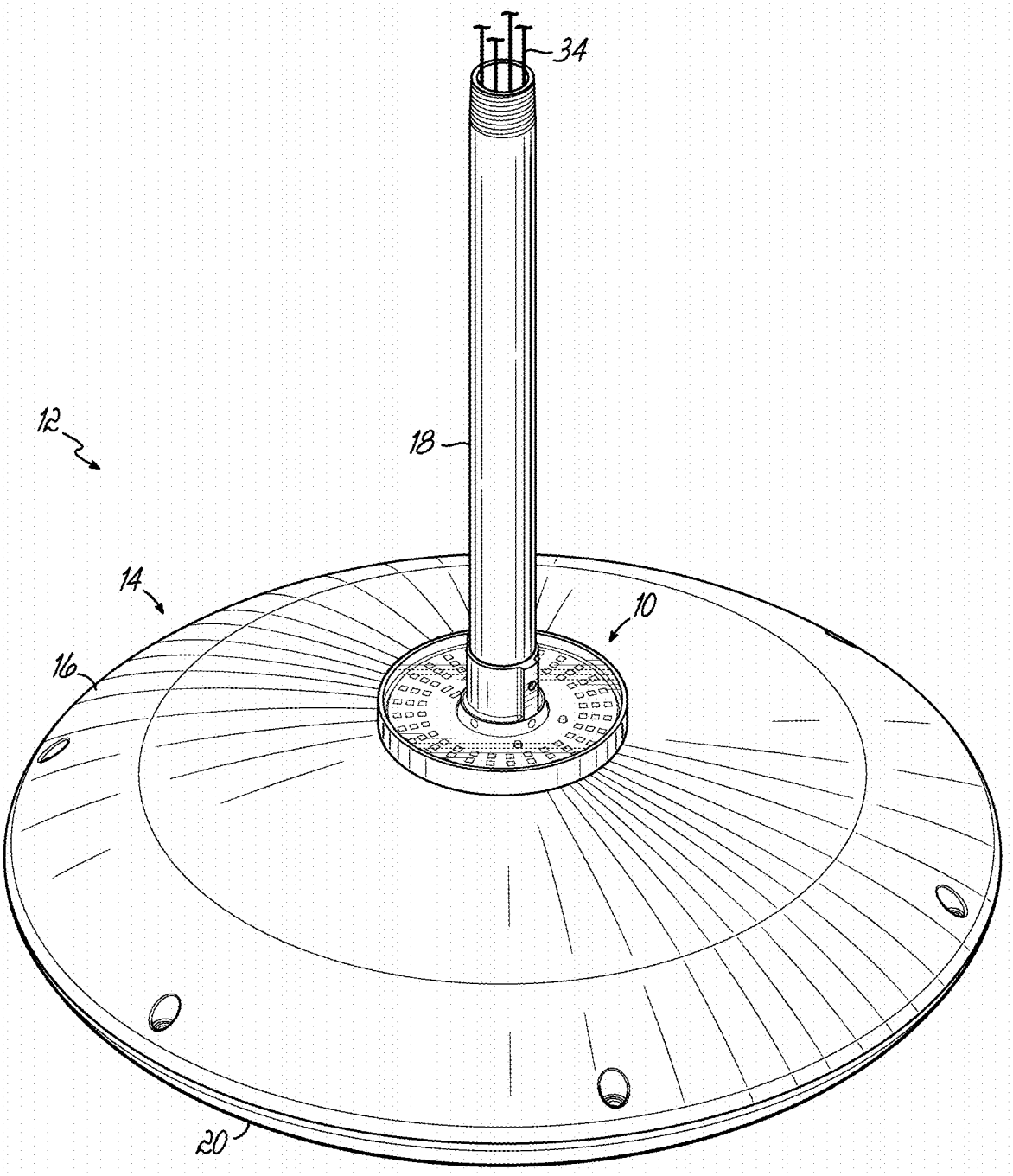
FIG. 2C is a perspective view of an exemplary luminaire assembly according to one embodiment of the invention, illustrating the uplight device of FIG. 1 assembled to the luminaire of FIG. 2A.

As shown in FIG. 2B, to install the uplight device 10 to the luminaire 14, the uplight device 10 is positioned between the stem 18 and the housing 16 of the luminaire 14. The second portion 62 of the body 38 of the uplight device 10 may then be threaded into the port 118 in the housing 16 to threadably couple the uplight device 10 to the luminaire 14. More particularly, the second portion 62 may be threadably received into the port 118 until the bottom edge 78 of the rim 42 abuts the housing 16 of the luminaire 14, as shown in FIG. 3. The threaded portion of the stem 18 may then be threadably coupled to the first portion 58 of the body 38 of the uplight device 10 to thereby couple the uplight device 10 to the luminaire 14, and more particularly between the housing 16 of the luminaire 14 and the stem 18, as shown in FIG. 2C. The set screw 72 may then be tightened against the stem 18 to prevent the stem 18 from inadvertently becoming uncoupled from the uplight device 10. However, assembly of the uplight device 10 to the luminaire 14 may be completed in a different manner, such as by assembling the stem 18 to the uplight device 10 before attaching the uplight device 10 to the housing 16 of the luminaire 14, for example.

With reference to FIG. 3, when the uplight device 10 is coupled to the luminaire 14, the electrical chamber 32, passageway 54, and wireway 36 through the stem 18 are in fluid communication. In that regard, the electrical wiring 106 for the substrate 44 of the uplight device 10 may be routed through the passageway 54 and electrically coupled to the driver 30 of the luminaire 14. As a result, the substrate 44 of the uplight device 10 may be powered and controlled by the driver 30 of the luminaire 14. Further, electrical wiring 34 for the driver 30 and luminaire 14 may be routed from the electrical component chamber 32 through the passageway 54 and through the wireway 36 in the stem 18 to an external power source (not shown) to power the luminaire assembly 12. In an alternative embodiment, the uplight device 10 may have a separate driver to power and control the substrate 44 and LEDs 50. In this embodiment, the uplight driver may be electrically coupled to an external power source or, alternatively, the luminaire 14.

Figure 4:
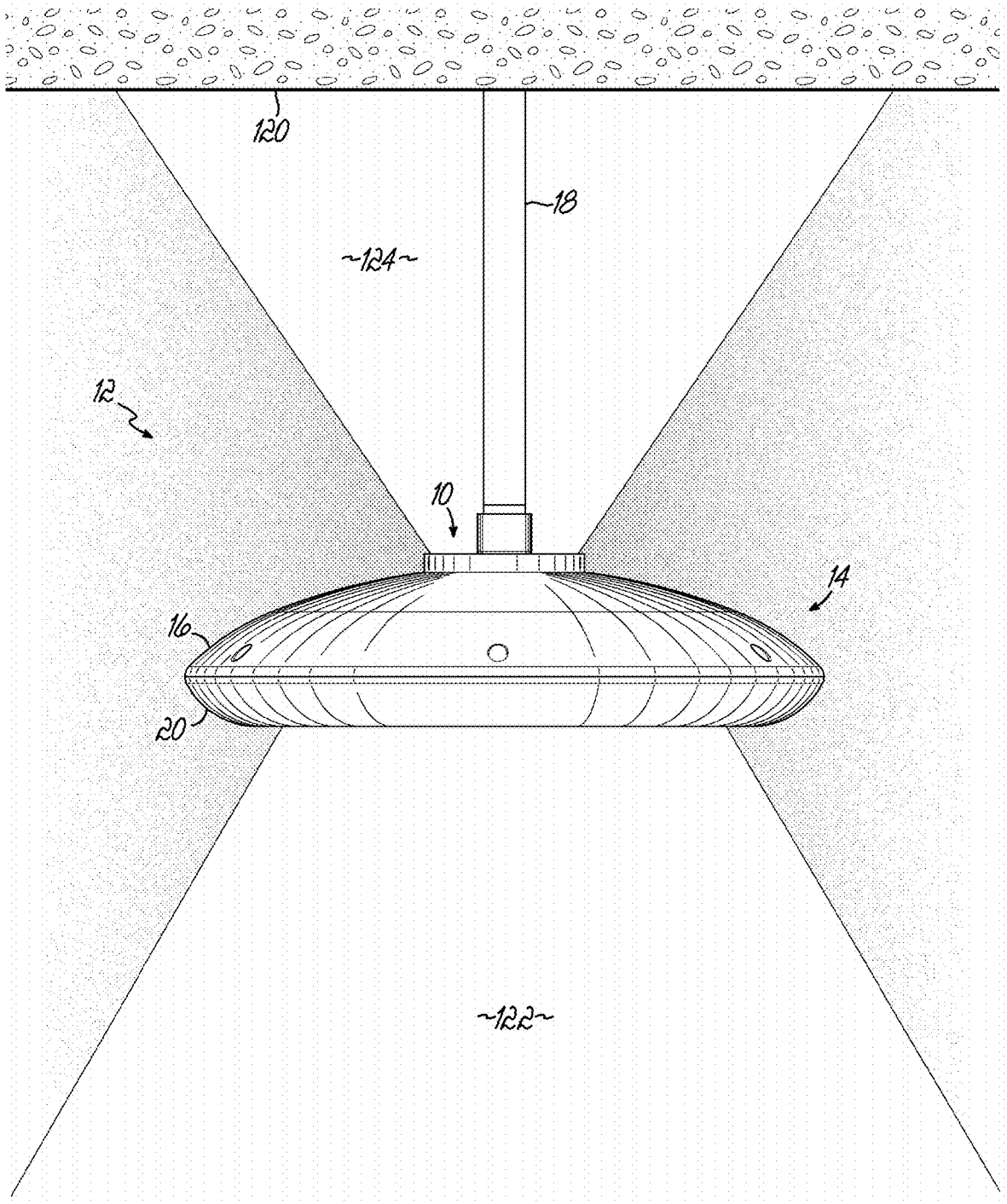
FIG. 4 is side view of the luminaire assembly of FIG. 2C mounted to an exemplary surface, illustrating the uplighting and downlighting capabilities of the luminaire assembly.

Turning now to FIG. 4, the luminaire assembly 12 may be mounted to a surface 120, such as a ceiling of a parking garage to illuminate an area of the parking garage. In this regard, the luminaire 14 provides a certain amount of downlight 122 (i.e., light projected in a downward direction) while the uplight device 10 provides a certain amount of uplight 124 (i.e., light projected in an upward direction). More particularly, the plurality of light emitting sources 50 of the uplight device 10 are configured to emit light in a direction away from the direction in which light is emitted from the plurality of light emitting sources 26 of the luminaire 14. As a result, the luminaire assembly 12 is provided with both uplighting and downlighting capabilities.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. An uplight device for use with a luminaire having a housing configured to be supported from a surface by a stem having a wireway, an optical frame coupled to the housing, and a luminaire substrate mounted within a chamber of the luminaire, the luminaire substrate having a plurality of light emitting sources arranged thereon and electrically coupled to a driver positioned within the chamber, the uplight device comprising:

a body having a radially outwardly directed annular flange, a vertically oriented annular rim encircling the annular flange, and a passageway extending through the body;

an uplight substrate supported on a first side of the annular flange and having a plurality of light emitting sources arranged in an array on a first side of the uplight substrate; and an optical lens covering the first side of the annular flange and the uplight substrate;

wherein the body is configured to be coupled between the stem and housing of the luminaire such that the passageway communicates with the wireway of the stem and the chamber of the luminaire.

2. The uplight device of claim 1, wherein the plurality of light emitting sources arranged on the uplight substrate are configured to emit light in a direction away from a direction in which light is emitted from the plurality of light emitting sources arranged on the luminaire substrate.

3. The uplight device of claim 1, wherein the passageway extends between an open end of a first portion of the body and an open end of a second portion of the body.

4. The uplight device of claim 1, wherein the substrate includes a through hole configured to receive the first portion of the body therethrough.

5. The uplight device of claim 3, wherein the first portion of the body is configured to threadably couple to the stem and the second portion of the body is configured to threadably couple to the housing of the luminaire.

6. The uplight device of claim 1, further comprising a chamber between an outer surface of the body, the first side of the flange, and the rim.

7. The uplight device of claim 6, wherein the substrate is positioned within the chamber.

8. The uplight device of claim 7, wherein the optical lens encloses the substrate within the chamber.

9. The uplight device of claim 1, wherein the optical lens is an optical encapsulant.

10. The uplight device of claim 1, wherein the body further includes a wireway extending through the body and fluidly communicating with the passageway, the wireway being configured to permit routing of electrical wiring between the uplight substrate and the driver of the luminaire.

11. The uplight device of claim 1, wherein the plurality of light emitting sources arranged in an array on a first side of the uplight substrate are arranged in a plurality of concentric circles.

12. The uplight device of claim 11, wherein each of the plurality of concentric circles are configured to output a different color of light.

13. The uplight device of claim 1, wherein the first side of the flange includes one or more alignment pins configured to engage one or more corresponding apertures in the uplight substrate.

14. A luminaire assembly comprising:

a luminaire having a housing configured to be supported from a surface by a stem having a wireway, an optical frame coupled to the housing, and a luminaire substrate mounted within a chamber of the luminaire, the luminaire substrate having a plurality of light emitting sources electrically coupled to a driver positioned within the chamber; and an uplight device, comprising:

a body having a radially outwardly directed annular flange, a vertically oriented annular rim encircling the annular flange, and a passageway extending through the body and between the stem of the luminaire assembly and the housing of the luminaire assembly;

an uplight substrate supported on a first side of the annular flange and having a plurality of light emitting sources arranged in an array on the uplight substrate; and an optical lens covering the first side of the annular flange and the uplight substrate;

wherein the passageway communicates with the wireway of the stem and the chamber of the housing.

15. The luminaire assembly of claim 14, wherein the plurality of light emitting sources arranged on the uplight substrate are configured to emit light in an opposite direction compared to a direction in which light is emitted from the plurality of light emitting sources arranged on the luminaire substrate.

16. The luminaire assembly of claim 14, wherein electrical wiring for the luminaire is routed through the passageway.

17. The luminaire assembly of claim 14, wherein the body further includes a wireway extending through the body and fluidly communicating with the passageway, the wireway being configured to permit routing of electrical wiring between the uplight substrate and the driver of the luminaire.

18. The luminaire assembly of claim 17, wherein electrical wiring for the luminaire and electrical wiring for the uplight substrate is routed through the passageway.

19. The luminaire assembly of claim 14, wherein the substrate includes a through hole through which the passageway extends.

20. The luminaire assembly of claim 14, wherein the plurality of light emitting sources arranged in an array on a first side of the uplight substrate are arranged in a plurality of concentric circles.

* * * * *